US009620899B2

(12) United States Patent
Kato et al.

(10) Patent No.: US 9,620,899 B2
(45) Date of Patent: Apr. 11, 2017

(54) CONNECTOR INCLUDING A PLURALITY OF CONNECTOR TERMINALS TO CONTACT AN APPARATUS-TERMINAL OF A CONNECTION COUNTERPART APPARATUS

(71) Applicant: Yazaki Corporation, Minato-ku, Tokyo (JP)

(72) Inventors: Hajime Kato, Kakegawa (JP); Tatsuya Goto, Kakegawa (JP); Hiroaki Imai, Kakegawa (JP)

(73) Assignee: Yazaki Corporation, Minato-ku, Tokyo (JP)

( * ) Notice: Subject to any disclaimer, the term of this patent is extended or adjusted under 35 U.S.C. 154(b) by 0 days.

(21) Appl. No.: 15/162,039

(22) Filed: May 23, 2016

(65) Prior Publication Data

US 2016/0268733 A1 Sep. 15, 2016

Related U.S. Application Data

(63) Continuation of application No. PCT/JP2014/084709, filed on Dec. 26, 2014.

(30) Foreign Application Priority Data

Dec. 26, 2013 (JP) ..... 2013-270510

(51) Int. Cl.
*H01R 13/58* (2006.01)
*H01R 13/631* (2006.01)
(Continued)

(52) U.S. Cl.
CPC ..... *H01R 13/631* (2013.01); *H01R 13/6315* (2013.01); *H01R 13/6581* (2013.01);
(Continued)

(58) Field of Classification Search
CPC H01R 13/5219; H01R 13/506; H01R 13/516; H01R 13/5812; H01R 13/5804; H01R 13/595; H01R 4/185
(Continued)

(56) References Cited

U.S. PATENT DOCUMENTS 5,697,806 A * 12/1997 Whiteman, Jr. ..... H01R 31/00 439/353
6,250,952 B1 * 6/2001 Shiga ..... F42B 3/188 439/466
(Continued)

FOREIGN PATENT DOCUMENTS

JP H01-159978 A 6/1989
JP H03-274684 A 12/1991
(Continued)

OTHER PUBLICATIONS

Mar. 24, 2015—Written Opinion of the ISA—Intl App PCT/JP2014/084709, Eng Tran.
(Continued)

*Primary Examiner* — Thanh Tam Le
(74) *Attorney, Agent, or Firm* — Banner & Witcoff, Ltd.

(57) ABSTRACT

A connector includes connector terminals having an elastically deformable contact portion which contacts an apparatus-terminal of a connection counterpart apparatus, a housing to which the connector terminals are assembled, a rotating member which is rotatable with respect to the housing by an external manipulation, and a movable member which moves the housing toward the connection counterpart apparatus via a motion direction converting mechanism which converts a rotation motion of the rotating member into a linear motion. The motion direction converting mechanism includes at least one projection in one of the housing and the movable member and at least one linear groove which meshes with the projection in the other one of
(Continued)

the housing and the movable member, wherein the projection and the linear groove are inclined with respect to a moving direction of the housing.

5 Claims, 5 Drawing Sheets

(51) Int. Cl.
*H01R 13/74* (2006.01)
*H01R 13/6581* (2011.01)
*H01R 13/6591* (2011.01)
*H01R 107/00* (2006.01)

(52) U.S. Cl.
CPC ..... *H01R 13/748* (2013.01); *H01R 13/6591* (2013.01); *H01R 2107/00* (2013.01)

(58) Field of Classification Search
USPC ..... 439/271, 466, 468, 470–473, 877
See application file for complete search history.

(56) References Cited

U.S. PATENT DOCUMENTS 6,276,960 B1 * 8/2001 Schaefer ..... H01R 11/287 439/466
6,815,610 B2 * 11/2004 Kuboshima ..... H01R 9/032 174/360
7,572,135 B2 * 8/2009 Kozono ..... H01R 13/6315 439/248
7,597,580 B1 * 10/2009 Advey ..... H01R 13/502 439/272
8,425,256 B2 * 4/2013 Aoki ..... H01R 13/688 439/620.26
8,485,844 B2 * 7/2013 Omae ..... H01R 13/5202 439/559
8,568,159 B2 * 10/2013 Noda ..... H01R 13/562 439/470
8,801,456 B2 * 8/2014 Miyakawa ..... H01R 13/111 439/466
9,039,463 B2 * 5/2015 Yamashita ..... H01R 13/187 439/449
9,083,107 B2 * 7/2015 Suzuki ..... H01R 13/5219
9,368,902 B2 * 6/2016 Nakai ..... H01R 13/5202

FOREIGN PATENT DOCUMENTS

JP H05-090844 U 12/1993
JP 2000-003757 A 1/2000
JP 2011-018579 A 1/2011
JP 2012-216455 A 11/2012

OTHER PUBLICATIONS

Mar. 24, 2015—International Search Report—Intl App PCT/JP2014/084709.

* cited by examiner

CONNECTOR INCLUDING A PLURALITY OF CONNECTOR TERMINALS TO CONTACT AN APPARATUS-TERMINAL OF A CONNECTION COUNTERPART APPARATUS

CROSS REFERENCE TO RELATED APPLICATIONS

This application is a continuation of international patent application No. PCT/JP2014/084709 filed Dec. 26, 2014 based on Japanese Patent Application No. 2013-270510 filed Dec. 26, 2013; the contents of which are incorporated herein by reference in its entirety.

BACKGROUND OF THE INVENTION

1. Field of the Invention

The present invention relates to a connector for electrically connecting a plurality of terminals to each other, and particularly to a connector which can reduce an insertion load when fitting respective apparatus-terminals to the plurality of connector terminals.

2. Description of the Related Art

As a connector structure for electrically connecting terminals to each other, for example, a structure in which two bus bar terminals having bolt holes are superposed to communicate with each of the bolt holes, and the bus bar terminals are fastened and fixed by bolts which communicate with the corresponding bolt holes (hereinafter, referred to as a structure in the first related art), is known. In the structure in the first related art, it is necessary to insert and fasten the bolts in the bolt holes which make the two bus bar terminals be superposed and communicate so that the punched bolt holes communicate with each other. Therefore, when connecting the plural groups of bus bar terminals, the work becomes complicated since all of the bolt holes of the bus bar terminals of a connection target should communicate with each other, and the bolts which are respectively inserted into each communicating bolt hole should be fastened several times, and thus, ease of assembly or productivity of the connector is likely to be deteriorated.

Here, as a connector structure in which the terminals are connected to each other without fastening the bolts, a structure in which male and female terminals are fitted to each other (hereinafter, referred to as a structure in the second related art) is widely used. In the structure in the second related art, by inserting a male terminal into a female terminal and pressing a contact spring which includes the female terminal to a contact of the male terminal, both terminals are electrically connected to each other. Therefore, it is not necessary to fasten the bolt for connecting the terminals to each other, but it is necessary to make the contact of the male terminal abut against the contact spring of the female terminal when connecting the terminals, and to insert the male terminal into the female terminal against a biasing force (spring reaction force) of the contact spring, and a predetermined insertion force is required. Therefore, since the biasing force of each contact spring is superposed when connecting the plurality of male and female terminals at the same time, the insertion force increases as much as the biasing force, and deterioration of ease of assembly or productivity of the connector is likely to be generated similar to the structure in the first related art.

To reduce the insertion force, a connector structure in which two bus bar terminals which are superposed in advance are placed in a temporary contact state, the bus bar terminals and pinched by the contact spring which is provided in a movable block material, and the plural groups of bus bar terminals are connected to each other at the same time, is disclosed in JP-A-2011-18579 as Patent Literature 1. According to the connector structure, by pushing the block material toward the superposed bus bar terminals by the bolt, the contact spring advances to and pinches the corresponding bus bar terminal together with the block material against the biasing force of the contact spring, the temporary contact state changes into a contact state being pressed by the contact spring, and the terminals are electrically connected to each other. In addition, a connector structure in which a connecting member which is separated from the terminal, such as the corresponding contact spring, is not provided, and the plurality of terminals are connected to each other by moving one terminal of the connection target toward the other terminal by rotating the bolt, is disclosed in JP-A-2000-3757 as Patent Literature 2. According to the connector structure, even when the plurality of terminals are electrically connected to each other, since only a space for rotating the bolt may be ensured, it is possible to perform the terminal connection work, even in a narrow location.

Patent Literature 1: JP-A-2011-18579

Patent Literature 2: JP-A-2000-3757

SUMMARY OF THE INVENTION

However, in the connector structure disclosed in Patent Literature 1, it is necessary that the connector on a connecting side is inserted into the connector on a connected side in advance so that the bus bar terminals of each connector on the connecting side and the connected side are superposed and are in the temporary contact state, and there is no change in that the insertion work becomes complicated to the same extent to which the number of bus bar terminals which are in the temporary contact state increases. In addition, it is necessary to position the movable block material provided with the plurality of contact springs in the connector on the connecting side in consideration of the biasing force of each contact spring. Therefore, it is necessary to configure the connector by considering not only the increase in the number of components, but also adjustment of the biasing force of each contact spring.

In addition, in the connector structure disclosed in Patent Literature 2, it is necessary to provide a cam groove in one of the connectors on the connecting side and the connected side, and a cam follower (projection) in the other connector. In other words, it is necessary to add an additional structure to both connectors on the connecting side and the connected side. Additionally, since it is necessary to position the corresponding cam groove and the projection between the connectors on the connecting side and the connected side, it is also necessary to add a positioning structure (a guide hole and a guide pin) to both connectors on the connecting side and the connected side.

The present invention is achieved based on this, and provides a connector which can reduce a terminal insertion load and improve workability at the same time by a structure which is relatively simple, even when connecting a plurality of terminals to each other.

In order to solve the above-described problems, a connector according to an aspect of the present invention includes: a plurality of connector terminals having an elastically deformable contact portion which contacts an apparatus-terminal of a connection counterpart apparatus; a housing to which the plurality of connector terminals are assembled; a rotating member which is rotatable with respect to the housing by an external manipulation; and a movable member which moves the housing toward the connection counterpart apparatus via a motion direction converting mechanism which converts a rotation motion of the rotating member into a linear motion, and brings the contact portion of the connector terminal into press-contact with the apparatus-terminal, in which the motion direction converting mechanism includes at least one projection in one of the housing and the movable member and at least one linear groove which meshes with the projection in the other one of the housing and the movable member, and the projection and the linear groove are formed to be inclined with respect to the moving direction of the housing.

According to this, since the connector terminal is moved toward the apparatus-terminal together with the housing by the movable member via the motion direction converting mechanism, it is possible to electrically connect the connector terminal and the apparatus-terminal to each other by bringing the contact portion into press-contact with the apparatus-terminal. Therefore, for example, even when some or all of the plurality of terminals are connected to each other, it is not necessary to add an additional connecting member for each connection unit in addition to the connector terminal and the apparatus-terminal. Therefore, the structure for connecting the terminals to each other does not become complicated, and it is possible to connect the plurality of terminals to each other integrally. In addition, for example, it is not necessary to temporarily insert (temporary contact to the contact portion) the apparatus-terminal into the connector terminal, and even when connecting the plurality of terminals to each other, there is not a case where the effort to perform the corresponding temporary insertion work or the temporary contact work increases to the same extent to which the number of terminals increases, and the work becomes complicated. Furthermore, it is not necessary to additionally change the connector structure of the connection counterpart apparatus. For example, it is not necessary to provide the cam groove in one of the connector and the connection counterpart apparatus, and the cam follower (projection) in the other one of the connector and the connection counterpart apparatus, and it is also not necessary to position the cam groove and the cam follower between the connector and the connection counterpart apparatus.

In this case, as an example of the motion direction converting mechanism, the housing and the movable member respectively have the inclination portions which are inclined rearward with respect to the moving direction of the housing and are in slidable contact with each other, and the linear groove can be formed to extend along the inclination of the inclination portion. Accordingly since it is possible to relatively move the projection along the linear groove while the inclination portions of the housing and the movable member are slidable to each other, at this time, it is possible to stabilize the posture of the housing and the movable member.

In addition, the connector includes an exterior member which surrounds the housing and is fixed to the connection counterpart apparatus, and a slit which linearly extends along the moving direction of the housing in one of the housing and the exterior member, and a boss which regulates the movement of the housing in a direction other than the moving direction being engaged with the slit in the other one of the housing and the exterior member. When rotating the bolt with respect to the housing, a force (pressing force) in a direction (bolt extending direction) which is perpendicular to the moving direction also acts on the housing since the projection is meshed with the linear groove, but it is possible to regulate the movement of the housing in the corresponding perpendicular direction by loading the corresponding pressing force due to the engagement of the boss and the slit. Meanwhile, it is possible to absorb (release) the corresponding pressing force by moving the boss along the slit. In other words, since the boss is guided along the slit while regulating the movement of the housing in a direction other than the direction toward the apparatus-terminal, it is possible to smoothly move the housing toward the apparatus-terminal.

In the related connector, the rotating member supports the movable member to be freely movable inside the exterior member, and a part of the rotating member is exposed to the outside of the exterior member. Accordingly, it is possible to move the housing by the movable member by rotating the rotating member after positioning the connector with respect to the connection counterpart apparatus by fixing the exterior member to the connection counterpart apparatus. Therefore, without bringing the contact portion of the female terminal into press-contact with the male terminal in advance (without generating an excessive pressing load, even if the contact portion of the female terminal and the male terminal come into contact with each other), only by rotating the rotating member after fixing the exterior member, it is possible to easily connect the connector terminal and the apparatus-terminal to each other.

In addition, if the exterior member is a shield shell which prevents noise generated from the inside of the connector from leaking to the outside, it is possible to ground the noise signal, such as an electromagnetic wave, via the connection counterpart apparatus. Therefore, since it is possible to electrically connect the connector terminal to the apparatus-terminal in a state where propagation of the noise due to leakage is prevented, it is also possible to prevent the influence of the noise on peripheral apparatuses.

According to the present invention, it is possible to realize a connector which can reduce a terminal insertion load and improve workability at the same time by a relatively simple structure, even when connecting some or all of a plurality of terminals to each other.

BRIEF DESCRIPTION OF THE DRAWINGS

FIGS. 3A to 3C illustrate a state of the connector which is in a state (connector non-fitted state) where a housing is positioned at a first position and a movable member is positioned at a first movable position, in which FIG. 3A is a view from above, FIG. 3B is a view from behind, and FIG. 3C is a view from a side.

FIGS. 4A to 4C illustrate a state of the connector which is in a state (connector fitting state) where the housing is moving from the first position to a second position, and the movable member is moving from the first movable position to a second movable position, in which FIG. 4A is a view from above, FIG. 4B is a view from behind, and FIG. 4C is a view from a side.

5A is a view from above, FIG. 5B is a view from behind, and FIG. 5C is a view from a side.

DETAILED DESCRIPTION OF THE EXEMPLARY EMBODIMENTS

Figure 1:
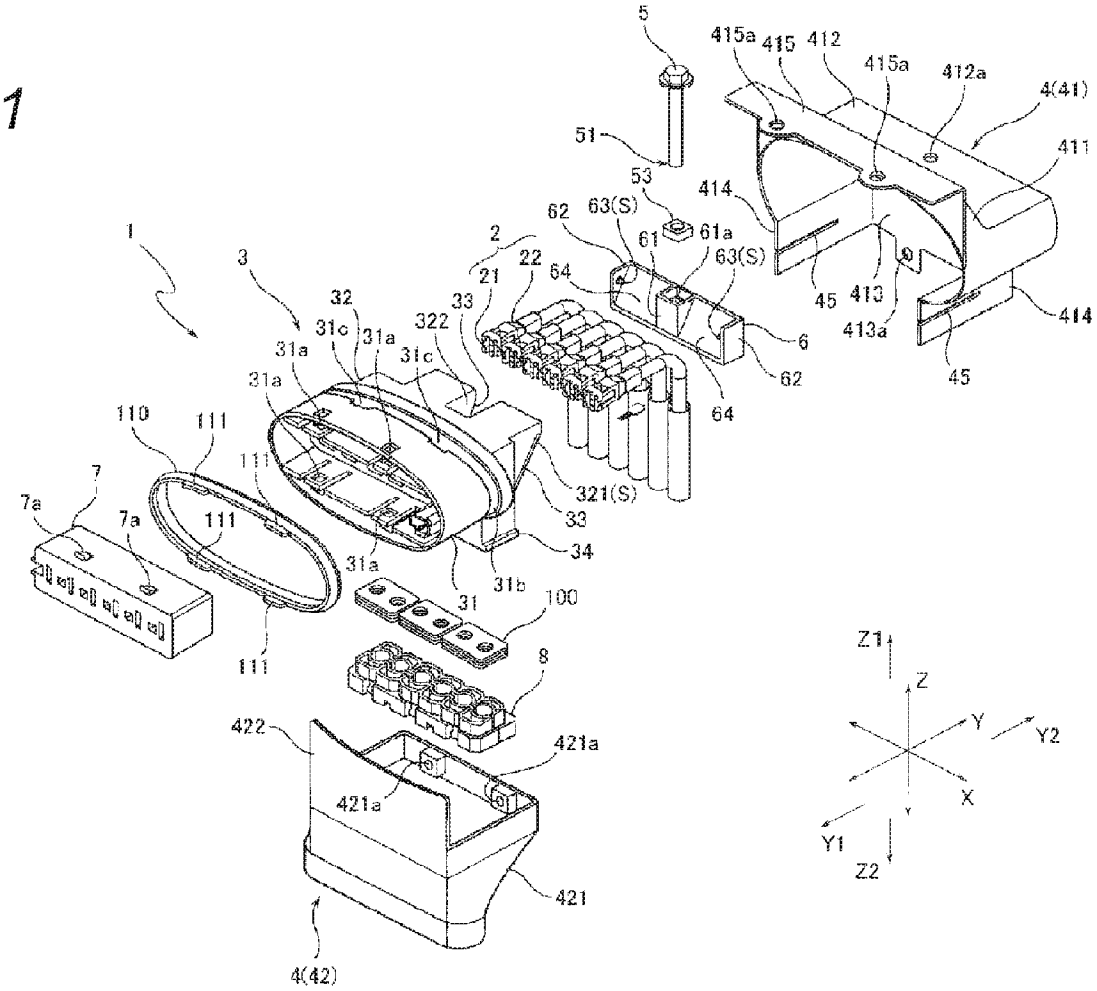
FIG. 1 is a perspective view illustrating a connector according to an embodiment of the present invention, in which the connector is disassembled into constituent members.
Figure 2:
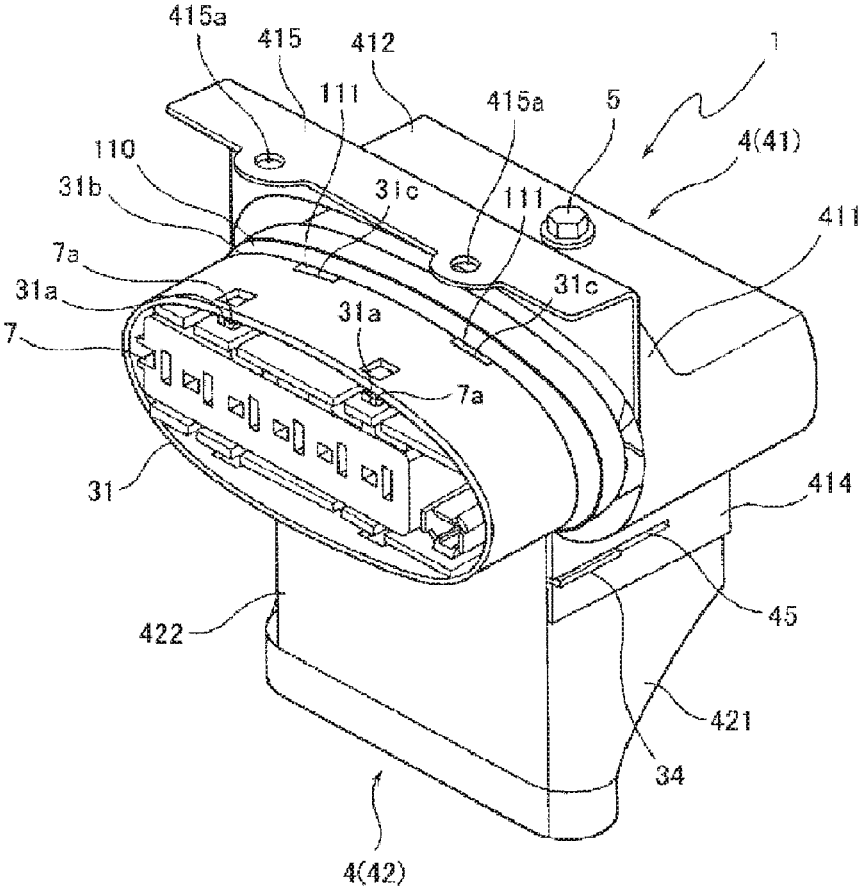
FIG. 2 is a perspective view of the entire connector illustrating a state where the constituent members illustrated in FIG. 1 are assembled.

Hereinafter, a connector of the present invention will be described with reference to the accompanying drawings. FIGS. 1 and 2 illustrate a configuration of the entire connector according to an embodiment of the present invention. FIG. 1 is a perspective view illustrating a connector, in which the connector is disassembled into constituent members. FIG. 2 is a perspective view of the entire connector illustrating a state where the constituent members illustrated in FIG. 1 are assembled. In the following description, an arrow X direction illustrated in FIG. 1 is a horizontal direction, an arrow Y direction is a lateral direction, and an arrow Z direction is a vertical direction. In addition, regarding the lateral direction, an arrow Y1 direction in FIG. 1 is specified as a front side (forward), and an arrow Y2 direction is specified as a rear side (rearward). Regarding the vertical direction, an arrow Z1 direction in FIG. 1 is specified as an upper side (upward), and an arrow Z2 direction is specified as a lower side (downward). However, the horizontal direction, the lateral direction, and the vertical direction do not necessarily match each direction in a state where the connector is connected to a connection counterpart apparatus in reality.

As illustrated in FIG. 1, a connector 1 includes a plurality of connector terminals 2 which have an elastically deformable contact portion 21 which contacts an apparatus-terminal 9 (refer to FIGS. 3A to 5C) of a connection counterpart apparatus 10, a housing 3 to which the plurality of connector terminals 2 are assembled, an exterior member 4 which surrounds the housing 3 and is fixed to the connection counterpart apparatus 10, a rotating member 5 which can rotate with respect to the housing 3 by an external manipulation, and a movable member 6 which moves the housing 3 toward the connection counterpart apparatus 10 via a motion direction converting mechanism S which converts a rotation motion of the rotating member 5 into a linear motion, and brings the contact portion 21 of the connector terminal 2 into press-contact with the apparatus-terminal 9.

In FIG. 1, a configuration of the connector 1 provided with six connector terminals 2 which are respectively attached to terminal portions of six electric wires 11 is illustrated, but the number of the connector terminals 2 is not particularly limited. For example, a connector provided with five or less connector terminals may be configured, or a connector provided with seven or more connector terminals may be configured. A connector configuration provided with only one connector terminal may also be technically established, but a connector configuration provided with a plurality of connector terminals is considered in the embodiment. In addition, a configuration in which the connector terminal 2 is attached to the terminal portion of the electric wire 11 is employed in FIG. 1, but a configuration in which the connector terminal is directly attached to a contact or the like of a circuit board can be employed. In summary, a configuration of a terminal which can be electrically connected to the connection counterpart apparatus 10 including the apparatus-terminal 9 may be employed. In other words, regardless of the number of the connector terminals 2, if the number of the apparatus-terminals 9 corresponds to the number of the connector terminals 2, a configuration in which the apparatus-terminal 9 can be electrically connected to an electronic apparatus in which the connector 1 is loaded via the connector terminal 2 may be employed. Therefore, a so-called male-female relationship of the connector terminal 2 and the apparatus-terminal 9 is not particularly limited, and the connector terminal 2 is a female terminal and the apparatus-terminal 9 is a male terminal in the embodiment, but a relationship opposite thereto can be considered.

The connector terminal 2 is formed of a conductive metal material, and is electrically connected to the apparatus-terminal 9 by bringing the connector terminal 2 into press-contact with the apparatus-terminal 9 by an elastic force (biasing force) that is applied as the contact portion 21 is elastically deformed. In addition, the connector terminal 2 has a base end portion 22 which supports the contact portion 21 and is connected to the terminal portion of the electric wire 11. In the embodiment, while the base end portion 22 supports the contact portion 21 facing forward, the base end portion 22 is joined to the terminal portion to make the electric wire 11 extend downward. In other words, in the embodiment, the connector 1 is configured as a bending (so-called L-shaped) type which substantially perpendicularly connects the connection counterpart apparatus 10 having the apparatus-terminal 9 to the electric wire 11 to which the connector terminal 2 is attached. Accordingly, it is possible to reduce the size of the connector 1 in the lateral direction, and to ensure a space on the rear side of the connector 1. However, it is also possible to configure a straight type connector which connects the electric wire 11 and the connection counterpart apparatus 10 along an extending direction of the electric wire 11.

The housing 3 has a structure in which a terminal accommodation portion 31 which is made in a substantially elliptic cylindrical shape and an electric wire accommodation portion 32 which is made in a substantially rectangular cylindrical shape are substantially perpendicularly continuous with each other. In other words, in the housing 3, the terminal accommodation portion 31 and the electric wire accommodation portion 32 are respectively opened forward and downward, and a substantially L-shaped space is formed on the inside thereof. The terminal accommodation portion 31 accommodates and holds the connector terminal 2 on the inside thereof, and the electric wire accommodation portion 32 accommodates and holds a terminal portion neighbor of the electric wire 11. In this case, the electric wire 11 to which the connector terminal 2 is connected is inserted from a lower opening of the electric wire accommodation portion 32, and the contact portion 21 of the connector terminal 2 faces the outside from the front opening of the terminal accommodation portion 31. The electric wire 11 which is accommodated and held in the electric wire accommodation portion 32 extends to the outside from the lower opening of the electric wire accommodation portion 32.

In the housing 3, a terminal holding member (hereinafter, referred to as an inner holder) 7 can be attached to the inside of the cylinder of the terminal accommodation portion 31, six connector terminals 2 inserted into the housing 3 are held by the inner holder 7 at a predetermined interval in the horizontal direction being adjacent to the contact portion 21. In this case, an engaged hole 31*a* is punched in the terminal accommodation portion 31, and an engaging projection 7*a* which is engaged with the engaged hole 31*a* is formed in the inner holder 7. Accordingly, while inserting the inner holder 7 into the terminal accommodation portion 31 from the front opening, it is possible to position and fix the inner holder 7 to the housing 3 by engaging the engaging projection 7*a* with the engaged hole 31*a*. In other words, the connector terminal 2 is assembled to the housing 3 via the inner holder 7 which is positioned and fixed to the housing 3. In addition, in the housing 3, an electric wire holding member (hereinafter, referred to as an electric wire holder) 8 can be attached to the inside of the electric wire accommodation portion 32, and six electric wires 11 which are connected to six connector terminals 2 are held by the electric wire holder 8 at a predetermined interval in the horizontal direction. Accordingly, it is possible to perform wiring in the connector 1 by aligning the electric wire 11 without unevenness. In addition, a sealing member (for example, a seal which is made of rubber or the like and has six through holes) 100 is mounted on the electric wire 11 above the electric wire holder 8, and the connection part between the electric wire 11 and the connector terminal 2 is prevented from being flooded (flooded across the electric wire 11) from a lower side.

In addition, in the housing 3, an annular sealing member (for example, a seal made of rubber or the like and has an elastic lip) 110 is mounted on a rear outer circumferential portion of the terminal accommodation portion 31, and sealing (waterproof or dustproof) in the housing 3 is achieved when the connection counterpart apparatus 10 having the apparatus-terminal 9, and the connector 1 are fitted to each other. In this case, the sealing member 110 has a rotation preventing piece 111, and by fitting the rotation preventing piece 111 into a fitting portion 31*c* formed in a seal mounting groove 31*b* of the terminal accommodation portion 31 and interrupting the rotation, the rotation is stopped with respect to the housing 3 (terminal accommodation portion 31).

In this manner, the housing 3 which accommodates and holds the connector terminal 2 and the electric wire 11 is surrounded by the exterior member 4. The exterior member 4 is fixed to the connection counterpart apparatus 10, and supports the housing 3 to be movable toward the apparatus-terminal 9 with respect to the exterior member 4. In the embodiment, the exterior member 4 supports the housing 3 via the rotating member 5 and the movable member 6. In addition, as an example in the embodiment, an exterior member (hereinafter, referred to as a shield shell) 4 is configured as a conductive case member which has a function of preventing the noise generated from the inside of the connector 1 from leaking to the outside, but the invention is not particularly limited thereto. According to the configuration, for example, it is possible to ground the noise, such as an electromagnetic wave, generated from the inside of the connector 1 via the connection counterpart apparatus 10 to which the shield shell 4 is assembled. Therefore, since it is possible to electrically connect the connector terminal 2 to the apparatus-terminal 9 in a state where propagation of the noise due to leakage is prevented, it is also possible to prevent the influence of the noise on peripheral apparatuses.

The exterior member 4 has a divided structure in which first shield shells (hereinafter, referred to as upper shield shells) 41 which respectively cover an upper portion of the terminal accommodation portion 31, and an upper portion, a rear portion, a left portion, and a right portion of the electric wire accommodation portion 32, a second shield shell (similarly, referred to as a lower shield shell) 42 which covers the periphery of the terminal portion neighbor of the electric wire 11, are assembled to be integrated. The upper shield shells 41 include an upper wall portion 411 which extends along a curve of an upper outer circumferential portion of the terminal accommodation portion 31, a flat portion 412 which extends in a flat shape to an upper portion of the electric wire accommodation portion 32 being linked to the upper wall portion 411, a rear wall portion 413 which is suspended from a rear circumferential edge of the flat portion 412, a side wall portion 414 which is suspended along the terminal accommodation portion 31 and the electric wire accommodation portion 32 from the side portions in the horizontal direction of the upper wall portion 411 and the flat portion 412, and a fixing portion 415 which stands upward from the front circumferential edge of the upper wall portion 411, and bends and extends forward. The upper shield shell 41 is positioned so that the upper wall portion 411 and the flat portion 412 cover the terminal accommodation portion 31 and an upper portion (the terminal accommodation portion 31 is a part thereof) of the electric wire accommodation portion 32, the rear wall portion 413 covers the rear portion of the electric wire accommodation portion 32, and the side wall portion 414 covers the left portion and the right portion of the terminal accommodation portion 31 and the electric wire accommodation portion 32, while maintaining a void, respectively. Meanwhile, the lower shield shell 42 includes a cylinder portion 421 which penetrates the electric wire 11 in the cylinder, and a front wall portion 422 which stands from a front side of an upper end of the cylinder portion 421. The upper end of the front wall portion 422 is formed in a concave shape along the curve of the lower outer circumferential portion of the terminal accommodation portion 31. The lower shield shell 42 is positioned so that the front wall portion 422 abuts against a front end of the side wall portion 414 of the upper shield shell 41, and the upper end of the front wall portion 422 abuts against the lower outer circumferential portion of the terminal accommodation portion 31.

In addition, the upper shield shell 41 and the lower shield shell 42 are integrated by screwing a bolt (not illustrated) which penetrates a through hole 413*a* punched in the rear wall portion 413 into a screw hole 421*a* formed on the cylinder portion 421, and accordingly, the shield shell 4 is formed. The shield shell 4 is assembled to the connection counterpart apparatus 10 by screwing the bolt (not illustrated) which penetrates a through hole 415*a* punched in the fixing portion 415 of the upper shield shell 41 into a screw hole 10*a* formed in the connection counterpart apparatus 10. In this case, a fastening direction of the bolt (fixing bolt) which penetrates the through hole 415*a*, and a fastening direction (vertical direction) of the rotating member (pull-up bolt) 5 which will be described later, match each other. Therefore, it is possible to enhance workability of assembly to the connection counterpart apparatus 10 without switching a tool for fastening, for example. In addition, advantages that the size of the connector 1 is reduced without ensuring a work space for fastening the fixing bolt to the rear side of the connector 1, or that the fastening work of the fixing bolt is easily performed, even when an additional component is disposed in the rear space, can be considered. By performing the fastening work of the fixing bolt, the connector 1 is positioned and fixed to the connection counterpart apparatus 10. In this case, in the connection counterpart apparatus 10, a hole portion 101 which can accommodate the terminal accommodation portion 31 of the housing 3 to communicate with the apparatus-terminal 9 and to make the apparatus-terminal 9 face the connector terminal 2 is formed, and the connector 1 is positioned and fixed to the connection counterpart apparatus 10 as the exterior member 4 is assembled to the connection counterpart apparatus 10 in a state where the terminal accommodation portion 31 enters the hole portion 101 (refer to FIGS. 3A to 5C).

The rotating member 5 is a member which can rotate with respect to the housing 3 by an external manipulation, and corresponds to a fastening member, such as a bolt or a screw, having a spiral groove which can be screwed to a fastened member. In the embodiment, a bolt (hereinafter, referred to as a pull-up bolt 5) which can fasten the fastened member together with a nut and which functions as a rotating member is employed as an example. The pull-up bolt 5 supports the movable member 6 to be freely movable inside the exterior member 4, and a part (bolt head portion) thereof is exposed to the outside of the exterior member 4. Accordingly, the head portion of the pull-up bolt 5 becomes easily accessible from the outside of the exterior member 4 at all times, and by applying the external manipulation (predetermined rotating force) to the bolt head portion, it is possible to rotate the pull-up bolt 5 with respect to the housing 3. In this case, the pull-up bolt 5 penetrates from a through hole 412*a* punched in the flat portion 412 of the upper shield shell 41, and passes through the upper shield shell 41 in the vertical direction to expose a tip end portion 51 to the outside. In a configuration illustrated in FIGS. 3A to 5C, a lower wall portion 417 which bends forward and is suspended lower being linked to the rear lower end of the rear wall portion 413 is formed in the upper shield shell 41, and the pull-up bolt 5 exposes the tip end portion 51 to the outside from a through hole (not illustrated) punched in the lower wall portion 417. In addition, a retaining ring (for example, an E ring) 52 is mounted at the exposure part, and the retaining ring 52 prevents the pull-up bolt 5 from falling out of the exterior member 4 by interrupting the circumferential edge portion of the through hole of the lower wall portion 417.

In addition, the movable member 6 is formed of a resin, and includes a nut holding portion 61 which holds a nut 53 screwed to the pull-up bolt 5, and a housing supporting portion 62 which supports the housing 3 on both sides in the horizontal direction nipping the nut holding portion 61. In the nut holding portion 61, a through hole 61*a* which penetrates the pull-up bolt which is in a state of being screwed to the nut 53 is punched, the tip end portion 51 of the pull-up bolt 5 which penetrates the through hole 61*a* is exposed from the through hole of the lower wall portion 417, and the retaining ring 52 is mounted at the exposure part. The nut 53 does not rotate together with the pull-up bolt 5 even when rotating the pull-up bolt 5 since the nut 53 is held by the nut holding portion 61, and accordingly, the movable member 6 moves in the extending direction (vertical direction) of the pull-up bolt 5 in accordance with the rotation of the pull-up bolt 5. In other words, the pull-up bolt 5 does not move in the vertical direction, even when the pull-up bolt 5 is rotated, and achieves a function of moving (raising) the movable member 6 in the vertical direction. The housing supporting portion 62 contacts the electric wire accommodation portion 32 from the rear side, and supports the housing 3 to nip and embrace the housing 3 from both sides in the horizontal direction.

In the embodiment, as the motion direction converting mechanism S, at least one projection in one of the housing 3 and the movable member 6, and at least one linear groove which meshes with the projection in the other one of the housing 3 and the movable member 6 are formed to be inclined with respect to the moving direction (forward in the lateral direction) of the housing 3. In the case, the movable member 6 is supported by the pull-up bolt 5, moves from a first movable position to a second movable position in the bolt extending direction (vertical direction) according to the rotation of the pull-up bolt 5, and moves the housing 3 from the first position to the second position toward the apparatus-terminal 9 with respect to the projection or the linear groove. In other words, in the connector 1 according to the embodiment, the rotation motion of the pull-up bolt 5 is converted to the motion of linearly moving (that is, linearly reciprocating in the lateral direction) of the housing 3 toward the apparatus-terminal 9 by the motion direction converting mechanism S (the projection and the linear groove). In addition, in the embodiment, moving (advancing) the housing 3 from the first position to the second position by moving (pulling up) the movable member 6 upward from the first movable position to the second movable position, is considered a basic operation. Therefore, the linear groove is formed to be inclined rearward with respect to the moving direction (forward in the lateral direction) of the housing 3. In contrast, in a case where the housing is advanced by moving (pushing down) the movable member downward from the first movable position to the second movable position, the inclination portion may be inclined forward with respect to the moving direction (forward in the lateral direction) of the housing.

By the motion direction converting mechanism S, at the first position, the connector terminal 2 is separated from the apparatus-terminal 9 together with the housing 3, and releases the press contact to the apparatus-terminal 9 of the contact portion 21, and at the second position, the connector terminal 2 approaches the apparatus-terminal 9 together with the housing 3, and brings the contact portion 21 into press-contact with the apparatus-terminal 9. In other words, the first position of the housing 3 and the first movable position of the movable member 6 corresponding thereto are set to be a position where the housing 3 makes the contact portion 21 of the connector terminal 2 separated from the apparatus-terminal 9 and releases the press contact. In addition, the second position of the housing 3 and the second movable position of the movable member 6 corresponding thereto are set to be a position where the housing 3 makes the contact portion 21 of the connector terminal 2 approach the apparatus-terminal 9 and be in press-contact, and electrically connects the connector terminal 2 and the apparatus-terminal 9. Accordingly, in the embodiment, when rotating the pull-up bolt 5 in a predetermined direction (for example, rightward, hereinafter, referred to as a normal rotation), the projection relatively moves along the linear groove, and moves (raises) the movable member 6 from the first movable position to the second movable position, and by the movement of the movable member 6, the housing 3 is moved (advanced forward) with respect to the exterior member 4 from the first position to the second position. Since the exterior member 4 is fixed to the connection counterpart apparatus 10, the housing 3 approaches the apparatus-terminal 9 together with the connector terminal 2 inside the hole portion 101 of the connection counterpart apparatus 10, and the connector terminal 2 brings the contact portion 21 into press-contact with the apparatus-terminal 9, and is electrically connected to the apparatus-terminal 9. Meanwhile, when rotating the pull-up bolt 5 in a direction (for example, leftward, hereinafter, referred to as reverse rotation) reverse to the above-described predetermined direction, the projection relatively moves along the linear groove, moves the movable member 6 from the second movable position to the first movable position, and by the movement of the movable member 6, the housing 3 moves (retracting rearward) with respect to the exterior member 4 from the second position to the first position. As a result, the housing 3 is separated from the apparatus-terminal 9 together with the connector terminal 2 inside the hole portion 101, and the connector terminal 2 releases the press contact to the apparatus-terminal 9 by the contact portion 21, and also releases the electric connection with the apparatus-terminal 9.

In the motion direction converting mechanism S according to the embodiment, for example, one projection 63 is formed in the movable member 6, and one linear groove 321 which meshes with the projection 63 is formed in the housing 3. However, in contrast to this, it is possible to consider a structure in which the linear groove is formed in the movable member 6, and the projection is formed in the housing 3. In addition, a configuration in which two or more projections and linear grooves are formed and can be meshed with each other, may also be employed.

The housing 3 and the movable member 6 respectively have inclination portions 33 and 64 which are inclined rearward with respect to the moving direction (forward in the lateral direction) of the housing 3, and are in slidable contact with each other. In this case, the inclination portion 33 of the housing 3 is formed to be inclined rearward in the rear upper portion of the electric wire accommodation portion 32. In contrast to this, the inclination portion 64 of the movable member 6 is formed to be inclined in the rear wall of the housing supporting portion 62. Both the inclination portions 33 and 64 may be inclined rearward at the same inclined angle (a degree of falling down with respect to the lateral direction), and the angle thereof may be arbitrarily set. Accordingly, when the movable member 6 vertically moves between the first movable position and the second movable position, it is possible to slidably move both the inclination portions 33 and 64 to each other. In addition, in the embodiment, since vertically moving (pulling up) the movable member 6 and advancing the housing 3 are considered a basic operation, the inclination portions 33 and 64 are inclined rearward with respect to the moving direction (forward in the lateral direction) of the housing 3. In contrast to this, in a case where the housing is advanced by moving (pushing down) the movable member downward, the inclination portion may be inclined forward with respect to the moving direction (forward in the lateral direction) of the housing. In addition, the electric wire accommodation portion 32 and the nut holding portion 61 are prevented from coming into contact (interrupting) with each other in a case where the movable member 6 is moved upward and the housing 3 is advanced, and a concave portion 322 which releases the nut holding portion 61 is formed to open rearward along the moving direction in the electric wire accommodation portion 32.

The projections 63 are respectively formed to protrude in a substantially columnar shape to the inside from the left wall and the right wall of the housing supporting portion 62. Meanwhile, the linear grooves 321 respectively extend to the left portion and the right portion of the electric wire accommodation portion 32 along the inclination of the inclination portion 33. Accordingly, since it is possible to relatively move the projection 63 along the linear groove 321 while bringing the inclination portion 33 of the housing 3 and the inclination portion 64 of the movable member 6 into slidable contact with each other, it is possible to stabilize the posture of the housing 3 and the movable member 6 at this time. In this case, the linear grooves 321 are set to have a slightly larger depth and width than the height and the width (radial dimension) of the protrusion of the projection 63, and are respectively formed in series in the left portion and the right portion of the electric wire accommodation portion 32. Both ends of the linear groove 321 in the lateral direction are fixing ends 321*a* and 321*b*, and the projection 63 can relatively move along the linear groove 321 between the fixing ends 321*a* and 321*b*. In other words, the projection 63 which relatively moves along the linear groove 321 abuts against the fixing ends 321*a* and 321*b*, and further movement thereof is regulated. The advancement and retraction of the housing 3 (connector terminal 2) with respect to the apparatus-terminal 9 is regulated. In this case, the position of the movable member 6 in the vertical direction and the position of the housing 3 in the lateral direction in a state where the projection 63 abuts against the front fixing end 321*a* correspond to the first movable position and the first position. In contrast to this, the position of the movable member 6 in the vertical direction and the position of the housing 3 in the lateral direction in a state where the projection 63 abuts against the rear fixing end 321*b* correspond to the second movable position and the second position. In addition, in the electric wire accommodation portion 32, a communication groove which communicates with the rear end of the linear groove 321, is parallel to the lateral direction, and makes a free end by falling off upward, may be formed (refer to FIGS. 3A to 5C).

In addition, in the embodiment, a slit which linearly extends along the moving direction (lateral direction) of the housing 3 is formed in one of the housing 3 and the shield shell 4, and a boss which regulates the movement of the housing 3 in a direction other than the lateral direction being engaged with the slit is formed in the other one of the housing 3 and the shield shell 4. For example, in FIGS. 1 to 5C, a configuration in which a slit 45 is formed in the shield shell 4 and a boss 34 is formed in the housing 3, is illustrated. However, in contrast to this, a configuration in which the slit is formed in the housing 3 and the boss is formed in the shield shell 4 can be considered. In addition, a configuration in which two or more slits and bosses are formed to be able to be engaged with each other, may be employed.

The boss 34 is formed so that any of the left portion and the right portion of the electric wire accommodation portion 32 respectively protrudes to the outside from the lower end. In this case, the boss 34 is continuous across the entire length (dimension in the lateral direction) of the lower end of the left and right portions of the electric wire accommodation portion 32. In addition, the boss 34 is not limited to the configuration of being continuous across the entire width in this manner, and for example, a configuration (a configuration of not being in series, and a part thereof is missing) in which the bosses 34 are intermittently scattered across the entire width can also be employed.

The slits 45 are respectively formed below an intermediate part in the vertical direction of one pair of side wall portions 414 of the upper shield shell 41. In this case, the slit 45 is continuous across substantially the entire length (dimension in the lateral direction) of one pair of side wall portions 414. The front end of the slit 45 is a free end, and the boss 34 can be taken into the slit 45 from the free end. Meanwhile, the rear end of the slit 45 is a fixing end, and the boss 34 which is taken into the slit 45 abuts against the fixing end. If the shape or the disposition of the slits 45 makes it possible the slit 45 to be engaged with the boss 34, the shape or the disposition are not particularly limited. In summary, the boss 34 and the slit 45 may be respectively formed in corresponding shape or disposition to be able to be engaged with each other. In addition, the width (dimension in the vertical direction) of the slit 45 is set to be slightly larger than the protrusion width (dimension in the vertical direction) of the boss 34.

When the projection 63 relatively moves along the linear groove 321, in a case where the pull-up bolt 5 normally rotates (or reversely rotate), an upward (or downward) force (pressing force) originating from the movable member 6 acts via the projection 63 in the housing 3. At this time, since the boss 34 of the housing 3 is engaged with the slit 45 of the shield shell 4, and the shield shell 4 is fixed to the connection counterpart apparatus 10, it is possible to regulate the upward (or downward) movement of the housing 3. Meanwhile, it is possible to absorb (release) the pressing force by moving the boss 34 along the slit 45. In other words, it is possible to regulate the movement of the housing 3 in a direction other than the lateral direction (that is, a direction toward the apparatus-terminal 9) by forming the boss 34 and the slit 45. In addition, since the boss 34 is guided along the slit 45, it is possible to smoothly move the housing 3 in the lateral direction. In other words, the slit 45 functions as a guide portion which moves the housing 3 in the lateral direction. In this case, the boss 34 is engaged near the rear part of the slit 45 in a state (a position at which the housing 3 separates the contact portion 21 of the connector terminal 2 from the apparatus-terminal 9 and releases the press contact) where the housing 3 is positioned at the first position (refer to FIGS. 3A to 3C). At this time, the boss 34 abuts against the rear end (fixing end) of the slit 45, and the movement (retraction from the apparatus-terminal 9) of the housing 3 (connector terminal 2) more toward the rear side than the first position is regulated. In addition, in a state where the housing 3 is positioned at the second position (a position where the housing 3 makes the contact portion 21 of the connector terminal 2 approach the apparatus-terminal 9 and brings the contact portion 21 into press-contact with the apparatus-terminal 9), the boss 34 is engaged at more toward the front side than the slit 45 (refer to FIGS. 5A to 5C). At this time, as described above, as the projection 63 abuts against the rear fixing end 321*b* of the linear groove 321, the movement (advancement to the apparatus-terminal 9) of the housing 3 (connector terminal 2) more toward the front side than the second position is regulated.

Figure 3A:
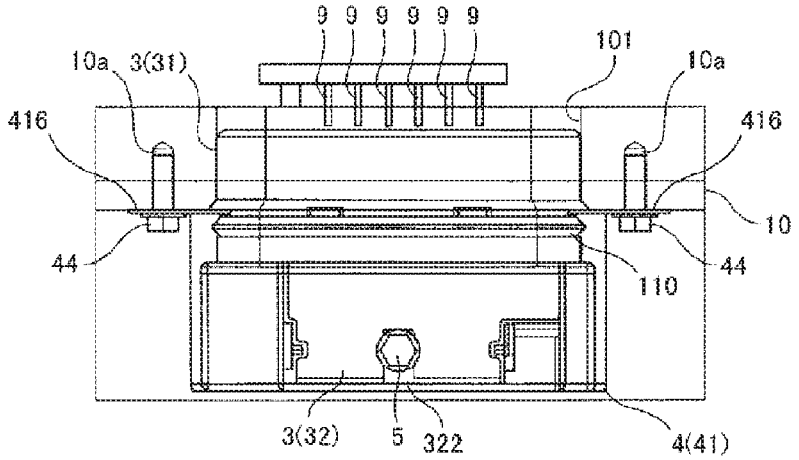
Figure 3B:
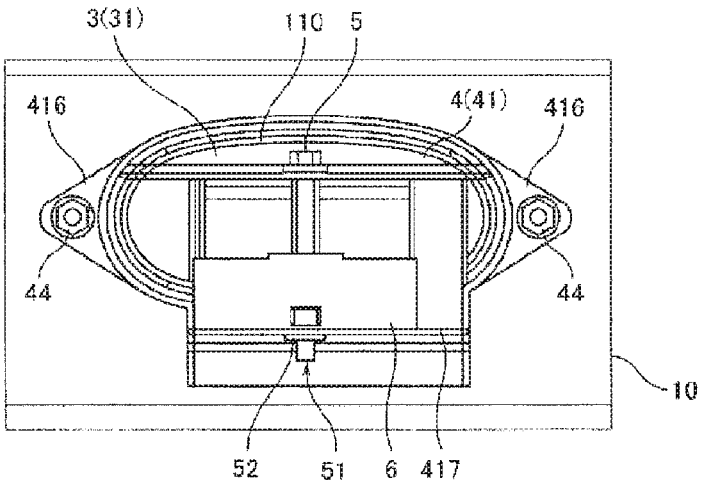
Figure 3C:
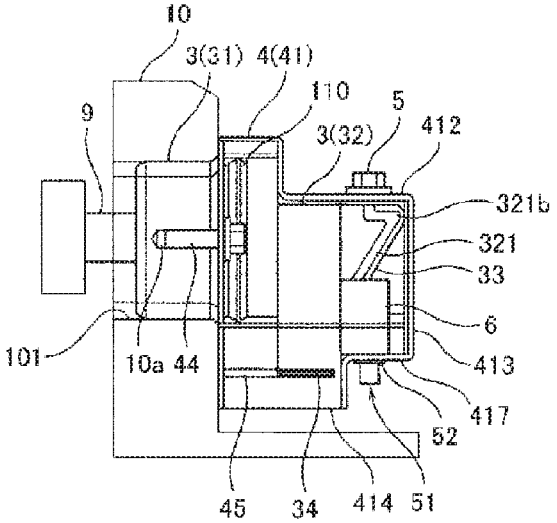
Figure 4A:
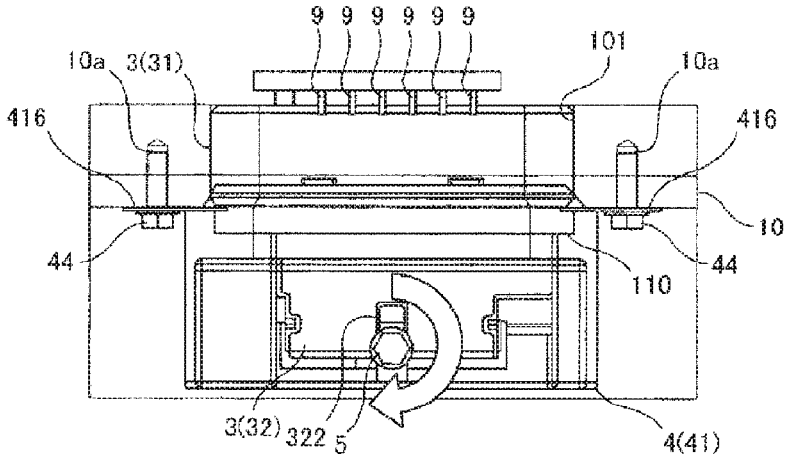
Figure 4B:
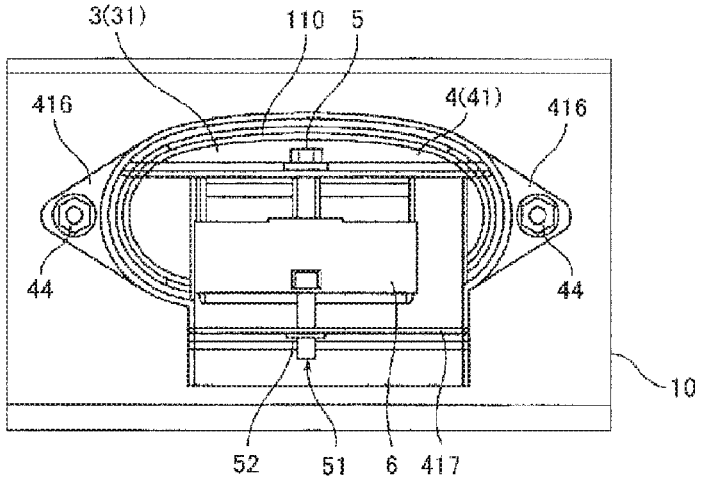
Figure 4C:
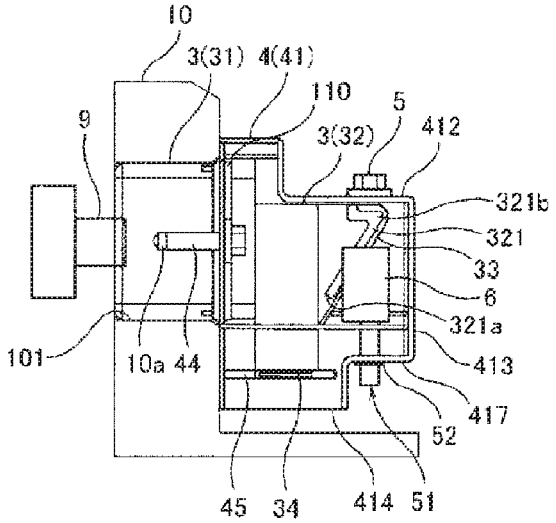
Figure 5A:
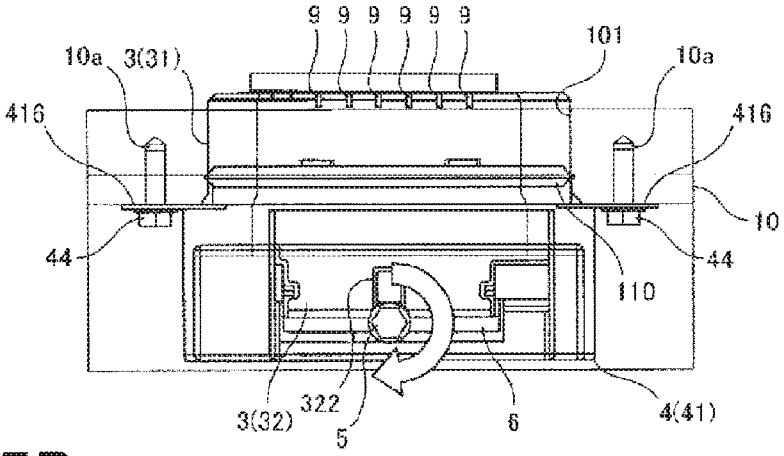
FIGS. 5A to 5C illustrate a state of the connector which is in a state (connector fitted state) where the housing is positioned at the second position, and the movable member is positioned at the second movable position, in which FIG.
Figure 5B:
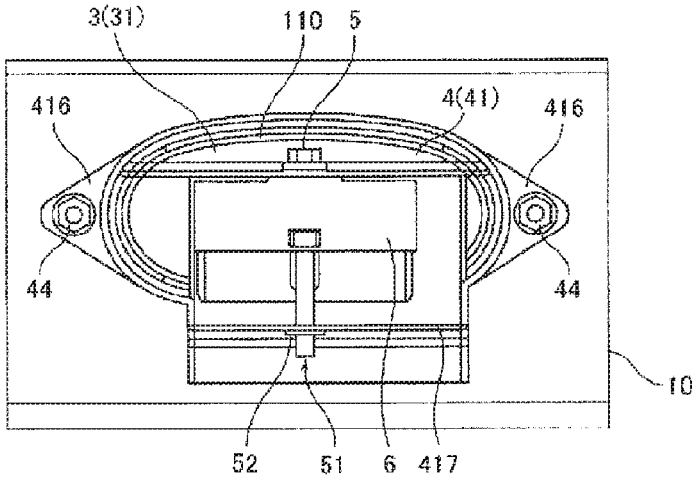
Figure 5C:
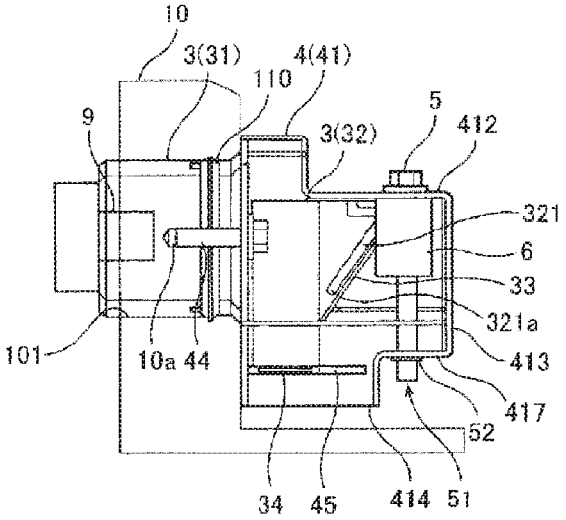

Here, operations of the housing 3, the pull-up bolt 5, and the movable member 6 when the connector terminal 2 and the apparatus-terminal 9 are electrically connected to each other in the connector 1 according to the embodiment, will be described with reference to FIGS. 3A to 5C. FIGS. 3A to 3C illustrate an aspect of the connector 1 in a state where the housing 3 is positioned at the first position and the movable member 6 is positioned at the first movable position (hereinafter, referred to as a connector non-fitted state). FIG. 3A is a view from above, FIG. 3B is from behind, and FIG. 3C illustrates from a side. FIGS. 4A to 4C illustrate an aspect of the connector 1 in a state where the housing 3 is moving from the first position to the second position and the movable member 6 is moving from the first movable position to the second movable position (hereinafter, referred to as a connector fitting state). FIG. 4A is a view from above, FIG. 4B is a view from behind, and FIG. 4C is a view from a side. FIGS. 5A to 5C illustrate an aspect of the connector 1 in a state where the housing 3 is positioned at the second position and the movable member 6 is positioned at the second movable position (hereinafter, referred to as a connector fitted state). FIG. 5A is a view from above, FIG. 5B is a view from behind, and FIG. 5C is a view from a side. In addition, the shield shell 4 and the connection counterpart apparatus 10 are illustrated to be partially transparent for convenience in FIGS. 3A to 5C so that it is possible to confirm the operation aspect of the housing 3 and the movable member 6 in the shield shell 4. In addition, in the configuration illustrated in FIGS. 3A to 5C, the upper shield shell 41 includes a flange portion 416 which extends in the horizontal direction from the front circumferential edge of the upper wall portion 411, and the lower wall portion 417 which bends forward and is suspended lower being linked to the rear lower end of the rear wall portion 413.

When the connection counterpart apparatus 10 having the apparatus-terminal 9 and the connector 1 are fitted to each other, the connector 1 in which the housing 3 and the movable member 6 are in the connector non-fitted state as illustrated in FIGS. 3A to 3C is positioned and fixed to the connection counterpart apparatus 10. Specifically, by screwing a bolt 44 which penetrates the through hole (not illustrated) of the flange portion 416 of the upper shield shell 41 to the screw hole 10*a* in a state where the terminal accommodation portion 31 is accommodated in the hole portion 101, the shield shell 4 is assembled to the connection counterpart apparatus 10. In this state, the connector 1 and the connection counterpart apparatus are not fitted to each other, the housing 3 is separated from the apparatus-terminal 9 together with the connector terminal 2, and the contact portion 21 of the connector terminal 2 does not come into press-contact with the apparatus-terminal 9. In addition, the projection 63 of the movable member 6 abuts against the fixing end 321*a* of the linear groove 321, the boss 34 of the housing 3 abuts against the rear end (fixing end) of the slit 45, and the movement (retraction from the apparatus-terminal 9) of the housing 3 (connector terminal 2) more toward the rear side than the first position is regulated.

When normally rotating (rotating in an arrow direction illustrated in FIG. 4A) the pull-up bolt 5 from the connector non-fitted state, according to this, the movable member 6 is moved upward, and the state is switched to the connector fitting state as illustrated in FIGS. 4A to 4C. In the connector fitting state, the projection 63 relatively moves along the linear groove 321, and advances the housing 3 forward with respect to the shield shell 4. Since the shield shell 4 is positioned and fixed to the connection counterpart apparatus 10 in the connector non-fitted state, and a stationary state is always maintained, the housing 3 advances toward the apparatus-terminal 9 together with the connector terminal 2. At this time, since the pressing force which acts on the linear groove 321 (that is, from the movable member 6 to the housing 3) from the projection 63 is absorbed by the engagement of the boss 34 and the slit 45, the housing 3 does not move upward with respect to the shield shell 4, and smoothly advances toward the apparatus-terminal 9 as the boss 34 is guided along the slit 45.

In addition, the pull-up bolt 5 is further normally rotated (rotation in an arrow direction illustrated in FIG. 5A), and the movable member 6 is raised to be in the connector fitted state illustrated in FIGS. 5A to 5C. In the connector fitted state, the projection 63 which relatively moves along the linear groove 321 abuts against the fixing end 321*b* of the linear groove 321, and the housing 3 is positioned at the second position. When the connector fitting state is switched to the connector fitted state, the housing 3 (connector terminal 2) further advances forward with respect to the shield shell 4, the connector terminal 2 presses the contact portion 21 to the apparatus-terminal 9, elastically deforms the contact portion 21, and brings the contact portion 21 into contact with the apparatus-terminal 9. Accordingly, it is possible to electrically connect the connector terminal 2 and the apparatus-terminal 9 each other, and the connection counterpart apparatus 10 and the connector 1 become fitted to each other. In addition, the further advancement of the projection 63 which abuts against the fixing end 321*b* of the linear groove 321 to the apparatus-terminal 9 of the housing 3 (connector terminal 2) is regulated. In addition, since the movement (raising and lowering) of the movable member 6 in the vertical direction is regulated by screwing the nut 53 held by the nut holding portion 61 of the movable member 6 and the pull-up bolt 5, not only the advancement but also the retraction of the housing 3 (connector terminal 2) with respect to the apparatus-terminal 9 are regulated. Accordingly, the electrically connected state (a pressure contact state of the apparatus-terminal 9 by the contact portion 21) of the connector terminal 2 and the apparatus-terminal 9 can be reliably maintained.

In addition, if the pull-up bolt 5 is reversely rotated, the movable member 6 is lowered, and the connector fitted state is switched to the connector non-fitted state, it is possible to make the housing 3 retract rearward with respect to the shield shell 4. Accordingly, by separating the housing 3 from the apparatus-terminal 9 together with the connector terminal 2, it is possible to release the press contact to the apparatus-terminal 9 of the contact portion 21. In this state, the electric connection of the connector terminal 2 and the apparatus-terminal 9 is released, the connection counterpart apparatus 10 and the connector 1 which are fitted to each other are disengaged from each other (the state illustrated in FIGS. 3A to 3C).

In this manner, according to the embodiment, regarding the electric connection of the connector terminal 2 and the apparatus-terminal 9, the pull-up bolt 5 may be rotated by the external manipulation after fixing the shield shell 4 to the connection counterpart apparatus 10 and positioning the connector 1 to the connection counterpart apparatus 10. In a state where the connector 1 is positioned and fixed to the connection counterpart apparatus 10 (connector non-fitted state), the contact portion 21 of the connector terminal 2 does not come into press-contact with the apparatus-terminal 9 (even if the contact portion 21 comes into press-contact with the apparatus-terminal 9, an excessive pressing load is not generated), and from this state, the connector terminal 2 advances toward the apparatus-terminal 9 together with the housing 3 by the rotation of the pull-up bolt 5. Accordingly, it is possible to bring the contact portion 21 into press-contact with the apparatus-terminal 9. In other words, since the connector terminal 2 may be advanced toward the apparatus-terminal 9 together with the housing 3 by raising the movable member 6 via the motion direction converting mechanism S (the projection 63 and the linear groove 321), even when the plurality of terminals are connected to each other, a connecting member (a contact spring or the like) is not additionally necessary in addition to the connector terminal 2 and the apparatus-terminal 9 for each connection unit. Therefore, it is possible to connect the plurality of terminals to each other integrally by the rotation (for example, impact fastening) of the pull-up bolt 5 without making the connection structure between the terminals complicated. In addition, for example, it is not necessary to temporarily insert (temporary contact to the contact portion 21) the apparatus-terminal 9 to the connector terminal 2 (however, temporary insertion (temporary contact) is also possible, and the possibility thereof is not excluded), and even when connecting the plurality of terminals to each other, there is not a case where the effort to perform the corresponding temporary insertion work or the temporary contact work increases to the same extent to which the number of terminals increases and the work becomes complicated. Furthermore, it is not necessary to additionally change the connector structure of the connection counterpart apparatus. For example, it is not necessary to provide a cam groove in one of the connector and the connection counterpart apparatus, and a cam follower (projection) in the other one of the connector and the connection counterpart apparatus, and it is also not necessary to perform the positioning the cam groove and the cam follower between the connector and the connection counterpart apparatus. Therefore, by using the connector 1 according to the embodiment, even when connecting the plurality of terminals to each other, it is possible to reduce the terminal insertion load and improve workability at the same time in a relatively simple structure.

Above, the present invention is described based on one embodiment illustrated in FIGS. 1 to 5C, but the above-described embodiment is merely an example of the present invention, and the present invention is not limited to the configuration of the above-described embodiment. Therefore, it is apparent to those skilled in the art that the present invention can be realized in changed or modified aspects within the range required by the present invention, and it is needless to say that the changed and modified aspects are included in the range of the patent claim of the present application.

The present invention is described with reference to a detailed and specific embodiment, but it is apparent for those skilled in the art that various changes and revisions can be made without departing from the spirit and the range of the present invention.

According to the present invention, an effect that it is possible to reduce a terminal insertion load and improve workability at the same time in a relatively simple structure, even when connecting a plurality of terminals to each other, is achieved. The present invention which achieves such an effect is efficient regarding a connector for electrically connecting the plurality of terminals to each other.

What is claimed is:

1. A connector comprising:

a plurality of connector terminals having an elastically deformable contact portion which contacts an apparatus-terminal of a connection counterpart apparatus;

a housing to which the plurality of connector terminals are assembled;

a rotating member which is rotatable with respect to the housing by an external manipulation; and a movable member which moves the housing toward the connection counterpart apparatus via a motion direction converting mechanism which converts a rotation motion of the rotating member into a linear motion, and brings the contact portion of the connector terminal into press-contact with the apparatus-terminal, wherein the motion direction converting mechanism includes at least one projection in one of the housing and the movable member and at least one linear groove which meshes with the projection in the other one of the housing and the movable member, wherein the projection and the linear groove are inclined with respect to a moving direction of the housing.

2. The connector according to claim 1, wherein the housing and the movable member respectively have inclination portions which are inclined rearward with respect to the moving direction of the housing in slidable contact with each other, and the linear groove extends along an inclination of the inclination portion.

3. The connector according to claim 1, further comprising:

an exterior member which surrounds the housing and is fixed to the connection counterpart apparatus, wherein a slit which linearly extends along an axial direction of the rotation is formed in one of the housing and the exterior member, and a boss which regulates movement of the housing in a direction other than the axial direction of the rotation being engaged with the slit is formed in the other one of the housing and the exterior member.

4. The connector according to claim 3, wherein the rotating member supports the movable member to be freely movable inside the exterior member, and a part of the rotating member is exposed to an outside of the exterior member.

5. The connector according to claim 3, further comprising:

the exterior member includes a shield shell which prevents noise generated from an inside of the connector from leaking to the outside.

* * * * *